US006802567B2

(12) United States Patent
Bell

(10) Patent No.: US 6,802,567 B2
(45) Date of Patent: Oct. 12, 2004

(54) CHAIR WITH SLIDE SKIN

(75) Inventor: Earl S. Bell, 53 Monroe St., 4th Fl., Brooklyn, NY (US) 11238

(73) Assignee: Earl S. Bell, Brooklyn, NY (US)

( * ) Notice: Subject to any disclaimer, the term of this patent is extended or adjusted under 35 U.S.C. 154(b) by 0 days.

(21) Appl. No.: 10/377,242

(22) Filed: Feb. 28, 2003

(65) Prior Publication Data

US 2003/0160493 A1 Aug. 28, 2003

Related U.S. Application Data

(60) Provisional application No. 60/361,030, filed on Feb. 28, 2002.

(51) Int. Cl.[7] ..... A47C 7/00; A47C 7/62
(52) U.S. Cl. ..... 297/440.11; 297/188.08
(58) Field of Search ..... 297/440.11, 188.08

(56) References Cited

U.S. PATENT DOCUMENTS 2,150,429 A * 3/1939 de Sanno ..... 297/411.42
2,509,638 A * 5/1950 Gunshor ..... 297/440.11
2,586,262 A * 2/1952 Robins ..... 5/120
3,298,737 A * 1/1967 Rosenfeld ..... 297/188.08
3,863,698 A * 2/1975 Uchida ..... 160/327
4,869,554 A * 9/1989 Abu-Isa et al. ..... 297/452.56
5,662,383 A 9/1997 Hand
5,762,403 A 6/1998 Robinson
5,911,478 A 6/1999 Goodman
6,494,540 B1 12/2002 Tornero
6,511,562 B1 * 1/2003 Coffield ..... 156/66
6,560,827 B1 * 5/2003 Gross ..... 24/265 C

* cited by examiner

*Primary Examiner*—Peter M. Cuomo
*Assistant Examiner*—Sarah C. Burnham
(74) *Attorney, Agent, or Firm*—Brian Roffe

(57) ABSTRACT

The invention is a chair having a removable surface (a "skin"), attachments, and a frame with a pair of opposing side members with channels to accept the attachments. The skin comprises cords incorporated into a material that has sufficient resiliency to bear the load of the chair user. The attachments have at least one portion, whereby a portion of the attachments connects to the cords of the skin and a portion of the attachments connects to a side member. The opposing side members have a hollow or grooved channel to accept a portion of the attachment used to connect the attachment to the side member. The skin attaches to the frame through the use of the attachments by, for each side of the skin, sliding the portion of the attachments used to connect the attachment to the side member into the channel of the side member. Replacement of the skin is relatively easy and can be accomplished by unskilled persons by sliding the attachments out of the opposing side members.

20 Claims, 4 Drawing Sheets

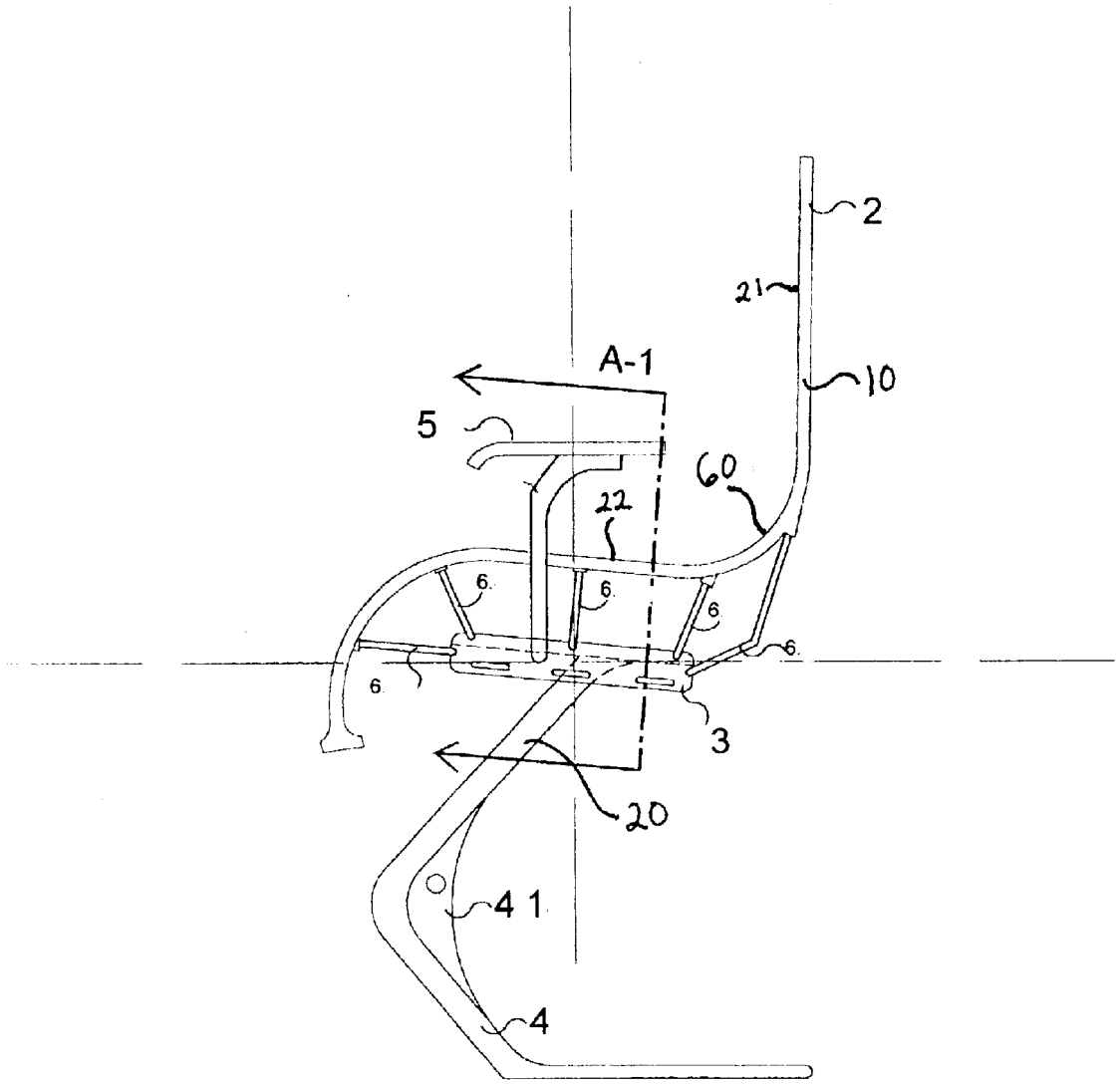
Figure # 1
Side View

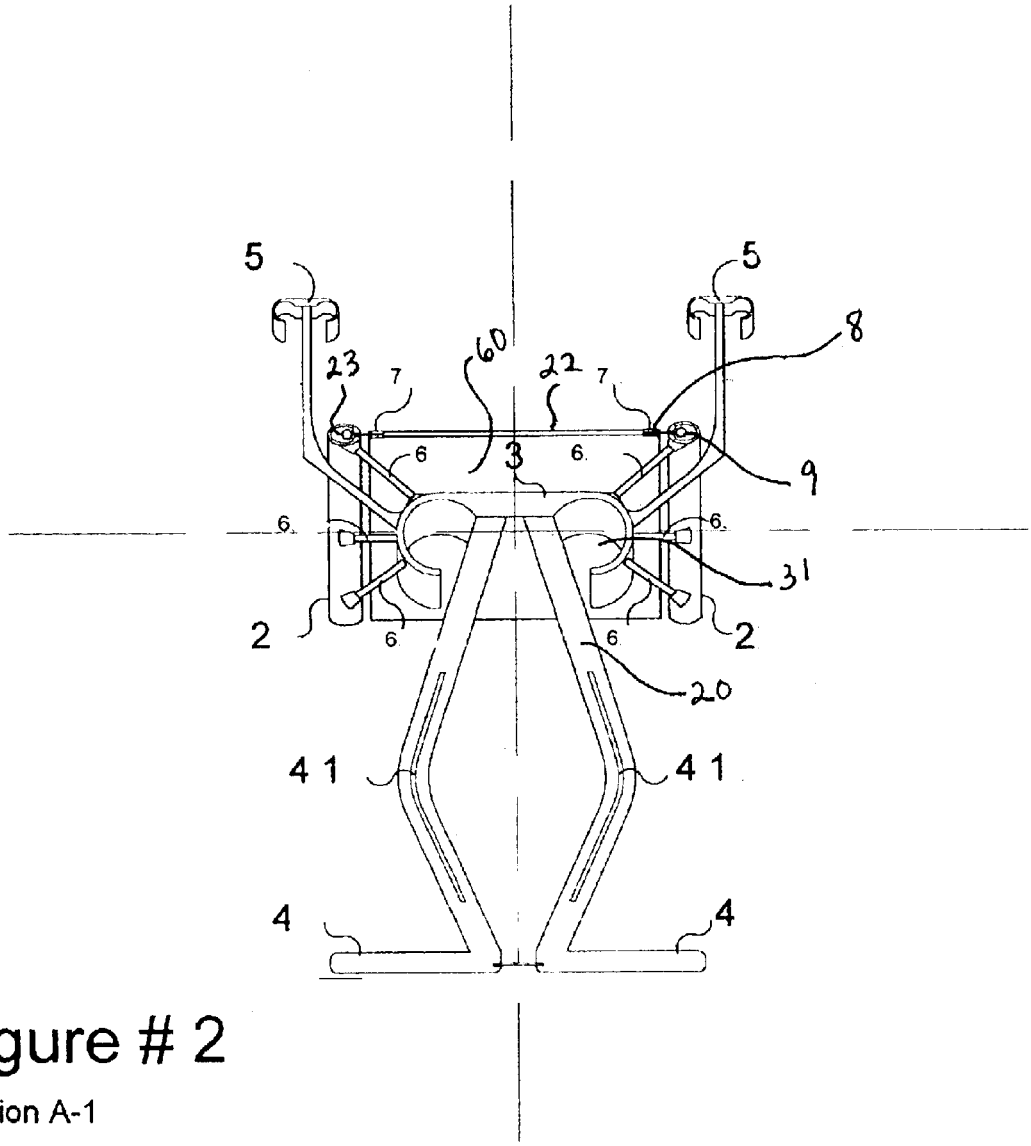
Figure # 2
Section A-1

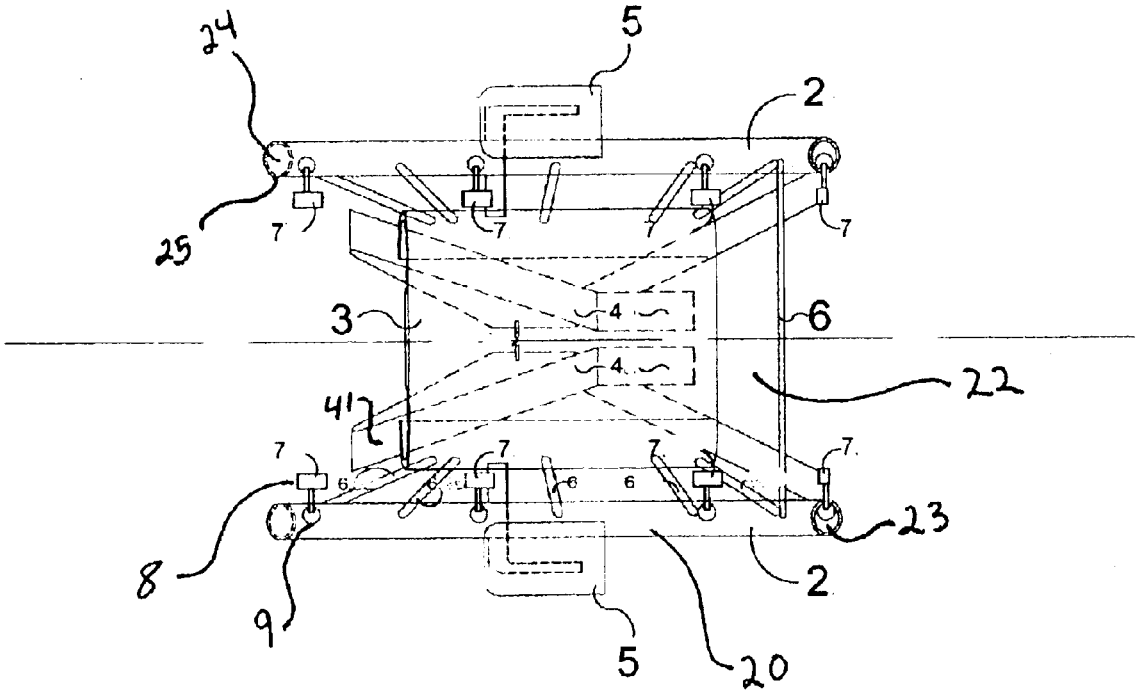
Figure # 3
Top View

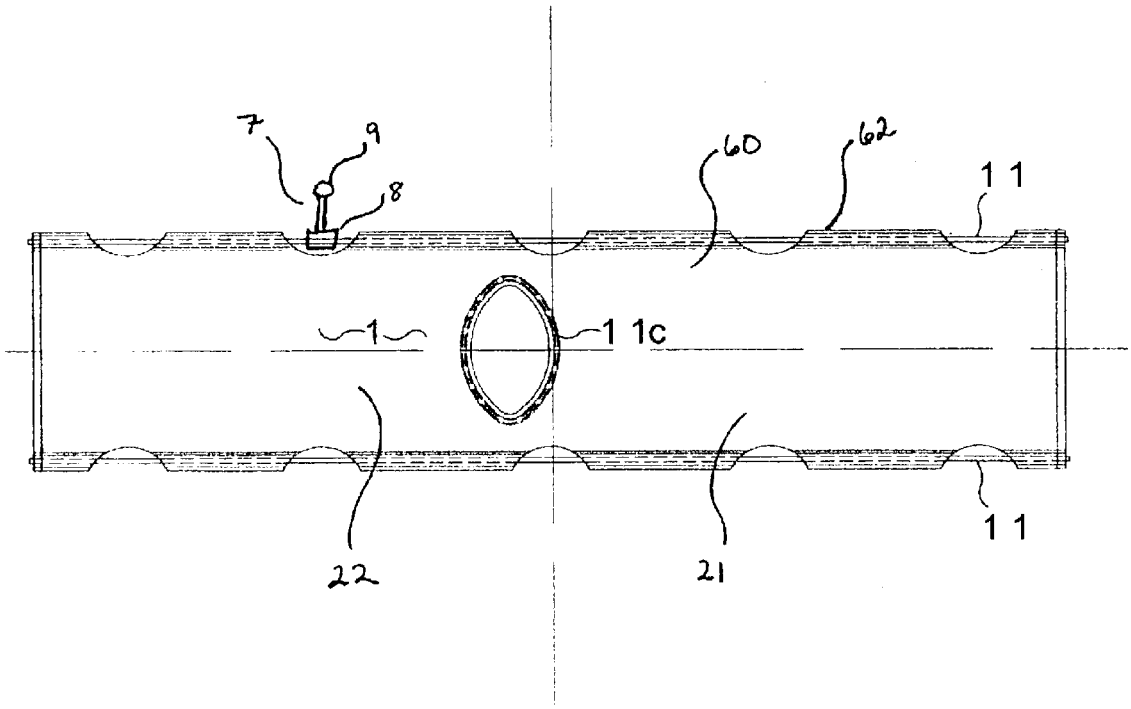
Figure # 4
Skin Envelope

CHAIR WITH SLIDE SKIN

This application claims the benefit of Provisional Application No. 60/361,030 filed Feb. 28, 2002 and titled Adwa Slide Skin Seat by Earl Bell.

BACKGROUND OF THE INVENTION

This invention relates generally to the field of chairs, more particularly to a chair with a feasibly replaceable, removable, or changeable surface.

Generally, the part of a chair which contacts the user of the chair is not feasibly replaceable, removable, or changeable by the user. Often, re-upholstering is necessary for a chair's surface to be removed, replaced, or changed. As such, chairs often become unsightly and worn as they are subjected to wear-and-tear, stains, and the other perils of everyday use. One of the objectives of the present invention is to provide a chair with a surface that is aesthetically pleasing, comfortable to use, and easily removed, replaced, or changed. Various other objectives and advantages of the present invention will become apparent to those skilled in the art as a more detailed description is set forth below.

The invention improves over chairs in general, and also improves over sling chairs specifically. Sling chairs are generally made of extruded metal tubing assembled into a rigid frame that defines the sides of a seating area. A sling rail, sections of tubing having channels formed therein for insertion of the sling, are positioned along the sides of the seating area, generally within the exterior confines of the frame. Usually, manufacturers of sling chairs first weld one sling rail to one side of the frame, insert the sling into the welded sling rail and the opposite loose sling and finally attach the loose sling rail to the opposite side of the frame. Commonly, the use of rivnuts and bolts are used to fasten the opposite loose sling rail to the frame thus tightening the sling material in place. In sling chairs, the seat and backrest are formed by a relatively heavy web of material that is tautly stretched across the lateral sides of the frame. The only way to remove the web of material from the chair frame is to dismantle the chair frame. Sling chairs are frequently used in leisure or private settings, as their appearance prevents them from being acceptable in others. Further, in those sling chairs where the user can remove, replace, or change the surface, it is difficult for the user to reacquire the necessary taughtness required to support a user of the chair.

Consequently, there is a need in the art for a chair with a surface which is removably attachable to the chair frame. There is a further need in the art for a chair with a removable surface which can be easily detached from the chair frame for cleaning and repair purposes. There is a further need in the art for the removably attachable surface to provide the resistance necessary to support a user of the chair, but that does not necessarily need to be extremely taught. There is a further need in the art for a chair with a removable surface which eliminates mechanical fasteners in the installation and removal of surfaces. There is further a need in the art for chairs with removable, replaceable, or changeable surfaces that are aesthetically acceptable in many settings, including professional settings.

SUMMARY OF THE INVENTION

The invention is a chair having a removable surface (a "skin"), attachments, and a frame with a pair of opposing side members with channels to accept the attachments. The skin comprises cords incorporated into a material that has sufficient resiliency to bear the load of the chair user. The attachments have at least one portion, whereby a portion of the attachments connects to the cords of the skin and a portion of the attachments connects to a side member. The opposing side members have a hollow or grooved channel to accept a portion of the attachment used to connect the attachment to the side member. The skin attaches to the frame through the use of the attachments by, for each side of the skin, sliding the portion of the attachments used to connect the attachment to the side member into the channel of the side member. Replacement of the skin is relatively easy and can be accomplished by unskilled persons by sliding the attachments out of the opposing side members.

In another embodiment the skin can actually be a combination of several skins, such as one skin for the seat area of the chair and one for the back area of the chair. In another embodiment, portions of the cords can be exposed, and further, the attachments can connect to the cords at the exposed portions. In another embodiment, the portion of the attachments that attaches to the skin can be hooks, clamp, or permanent fixtures. In another embodiment, the skin can be tailored to desirable specifications. In another embodiment, the frame of the chair can include storage compartments for skins.

The invention provides advantage by affording easy removal of the skin from the chair frame. Moreover, such removal of the skin does not require any tools or expertise. The chair provides a frame with a removable skin that, when attached to the frame, provides a support surface. The chair thus provides a support surface that can be easily replaced, removed or changed for aesthetic or maintenance purposes. Such advantages are not met by chairs having permanently attached fabric.

Other features and advantages of the invention will become apparent to those skilled in the art upon review of the following detailed description, claims and drawings.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings which illustrate preferred and exemplary embodiments, and wherein:

FIG. 1 is a side view of a chair embodying the invention.

FIG. 2 is a cross-sectional view taken along line A-1 FIG. 1.

FIG. 3 is a top view of a chair embodying the invention.

FIG. 4 is a perspective view of a skin made in accordance with the present invention which is not attached to the chair frame.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Referring now to the drawings, FIG. 1 illustrates a chair 10 with a removable skin 60 made in accordance with the present invention. The chair 10 has a frame 20 that is formed of plastics, alloys, or other materials which are bent and welded or otherwise joined to form the frame 20. The frame 20 includes side members 2, a structural hub 3, feet 4, legs 41, arm rests 5, and connection rods 6. The removable skin 60 forms a back area 21 and a seat area 22.

As shown in FIG. 2, the skin 60 is removably attached to the side members 2 using attachments 7. The attachments have two portions, a portion that attaches to the skin 8 and a portion that attaches to the side members 9. The side members 2 have hollow or grooved channels 23. The portion of the attachments 7 that attaches to the side members 9 is smaller than the channels 23 contained within the side members 2 to allow insertion of the portion of the attachments 7 that attaches to the side members 9 into the channels 23 thereby removably attaching the skin 60 to the side members 2. In addition to the side members 20, the frame 20 includes a structural hub 3, feet 4, legs 41, arm rests 5, and connection rods 6. The removable skin forms a seat area 22. The structural hub 3 contains storage compartments 31 for items, such as skins not in use.

As shown in FIG. 3, the side members 2 have a hollow or grooved channel 23. The skin 60 is connected to the side members 2 by attachments 7. The attachments have a portion that connects to the skin 8 and a portion that connects to the side members 9. The portion of the attachments that connects to the side members 9 connects to the side members 2 through insertion into the hollowed or grooved channel 23. In addition to the side members 20, the frame 20 includes a structural hub 3, feet 4, legs 41, arm rests 5, and connection rods 6. The removable skin forms a seat area 22.

As shown in FIGS. 1, 2, and 3, the skin 60 is removably attached to the side members 2 in a relatively simple manner. Each channel 23 has an open end 24 and a slit 25 along the entire length of the channel 23. The portion of the attachments 7 that attaches to the side members 9 are "slid" into the corresponding open ended channels 23 within the side members 2. Once the portion of the attachments that attaches to the side members 9 are placed into the channels 23, the skin 60 is pulled in the direction of the side members 2 to form a back area 21 and a seat area 22. As seen in FIG. 3, the slit 25 allows the skin 60 to slide and cover the chair frame thereby forming the back area 21 and the seat area 22.

As shown in FIG. 4, the removable skin 60 is of a size forming the back area 21 and seat area 22 of the chair. The removable skin 60 has cords 11 incorporated into a material 1. Some of the cords form opposite skin edges 62, to which the portion of the attachments that attaches to the skin 8 attaches. In one embodiment, portions of the cords can be exposed and the attachments 7 can be attached to the skin 60 at those exposure areas. The skin 60 is preferably made of a material that is capable of supporting the tensile forces which result from a person sitting on the chair. Skin materials possibly could be vinyl coated polyester fabric, acrylic fabrics, leather, or other materials which are suitable for this purpose and/or use.

What is claimed is:

1. A chair assembly comprising:

a frame comprising a pair of opposing side members with a channel having a length, an open end and a slit extending continuously along the length of the channel from the open end;

a skin comprising a material and a plurality of cord portions attached to the material; and a plurality of attachments, a first set of the attachments including a first portion attached to a first one of the cord portions and a second portion attached to a first one of the side members, the second portion being arranged at least partially inside of the channel in the first side member and extending through the slit in the first side member, a second set of the attachments including a first portion attached to a second one of the cord portions and a second portion attached to a second one of the side members, the second portion being arranged at least partially inside of the channel in the second side member and extending through the slit in the second side member, the second portions of the attachments being slidable into the channels through the open end of the channels and slidable through the channels to enable the skin to be attached and detached from the side members.

2. The chair assembly as set forth in claim 1, wherein the frame comprises a structural hub.

3. The chair assembly as set forth in claim 2, wherein the structural hub has at least one storage compartment.

4. The chair assembly as set forth in claim 1, wherein one of the cord portions provides support and comfort to a rear end of a user of the chair assembly.

5. The chair assembly as set forth in claim 1, wherein a portion of at least one of the cord portions is not covered by the material.

6. The chair assembly as set forth in claim 5, wherein the first portion of each of the attachments attached to one of the cord portions is attached to the portion of the respective cord portion that is not covered by the material.

7. The chair assembly as set forth in claim 1, wherein the slit of each of the side members is arranged in a side of the channel facing the skin.

8. The chair assembly as set forth in claim 1, wherein the cord portions are permanently affixed to the material.

9. The chair assembly as set forth in claim 1, wherein the slit in each of the side members is continuous along substantially the entire length of the channel.

10. The chair assembly as set forth in claim 1, wherein the skin defines a seat area and a back area and the frame comprises a structural hub arranged below and not in contact with the seat area, the hub including at least one storage compartment.

11. The chair assembly as set forth in claim 10, wherein the frame further comprises a pair of arm rests connected to and extending upward from the hub and a pair of legs extending downward from the hub.

12. The chair assembly as set forth in claim 10, wherein the hub includes a plurality of storage compartments.

13. The chair assembly as set forth in claim 10, wherein the frame further comprises connection rods for connecting the hub to the side members.

14. The chair assembly as set forth in claim 1, wherein the skin defines a seat area and a back area.

15. The chair assembly as set forth in claim 1, wherein the cord portions include a first cord arranged along a first side of the skin and to which the first portion of the first set of attachments is attached, and a second cord arranged alongside a second side of the skin opposed to the first side of the skin and to which the first portion of the second set of attachments is attached.

16. The chair assembly as set forth in claim 15, wherein a portion of each of the first and second cords is not covered by the material.

17. The chair assembly as set forth in claim 16, wherein the first portion of each of the attachments attached to the first or second cord is attached to the portion of the respective cord that is not covered by the material.

18. The chair assembly as set forth in claim 15, wherein the first and second cords are permanently affixed to the material.

19. The chair assembly as set forth in claim 1, wherein the second portion of the attachments includes a part with a larger size than a size of the slit to prevent the second portion from passing entirely through the slit.

20. The chair assembly as set forth in claim 1, wherein each of the first and second sets of attachments includes a plurality of attachments.

* * * * *